US011993895B2

(12) United States Patent
Andrade et al.

(10) Patent No.: US 11,993,895 B2
(45) Date of Patent: May 28, 2024

(54) METHOD OF FEEDING WOOD CHIPS TO A PREHYDROLYSIS REACTOR

(71) Applicant: ANDRITZ OY, Helsinki (FI)

(72) Inventors: Marco Andrade, Curitiba (BR); Ronny Geiger, Curitiba (BR); Vesa Kaipainen, Kotka (FI); Auvo Kettunen, Kotka (FI); Petri Tarjavuori, Lappeenranta (FI); Viridiane Vianna, Curitiba (BR)

(73) Assignee: ANDRITZ OY, Helsinki (FI)

( * ) Notice: Subject to any disclaimer, the term of this patent is extended or adjusted under 35 U.S.C. 154(b) by 478 days.

(21) Appl. No.: 17/282,451

(22) PCT Filed: Oct. 2, 2019

(86) PCT No.: PCT/FI2019/050706

§ 371 (c)(1),
(2) Date: Apr. 2, 2021

(87) PCT Pub. No.: WO2020/070389

PCT Pub. Date: Apr. 9, 2020

(65) Prior Publication Data

US 2022/0002944 A1 Jan. 6, 2022

(30) Foreign Application Priority Data

Oct. 3, 2018 (FI) ..... 20185831

(51) Int. Cl.
*D21C 1/06* (2006.01)
*D21C 3/24* (2006.01)
(Continued)

(52) U.S. Cl.
CPC ..... *D21C 1/06* (2013.01); *D21C 3/24* (2013.01); *D21C 3/26* (2013.01); *D21C 7/06* (2013.01)

(58) Field of Classification Search
CPC ... D21C 1/06; D21C 3/24; D21C 3/26; D21C 7/06; D21C 1/02; D21C 7/00
See application file for complete search history.

(56) References Cited

U.S. PATENT DOCUMENTS 6,336,993 B1 * 1/2002 Stromberg ..... D21C 7/06 162/10
8,128,784 B2 3/2012 Vilpponen et al.
(Continued)

FOREIGN PATENT DOCUMENTS

CA 2 345 759 11/2001
JP 11323757 A 11/1999
(Continued)

OTHER PUBLICATIONS

International Search for PCT/FI2019/050706, dated Jan. 9, 2020, 4 pages.
(Continued)

*Primary Examiner* — Jacob T Minskey
*Assistant Examiner* — Matthew M Eslami
(74) *Attorney, Agent, or Firm* — Nixon & Vanderhye P.C.

(57) ABSTRACT

A method for feeding a slurry of chips and liquid to a prehydrolysis reactor in the production of dissolving pulp. The slurry is pumped by using at least one pump to the reactor, and alkali is fed into the at least one pump 5 for adjusting the pH of the slurry to a range of 7-10.

18 Claims, 3 Drawing Sheets

(51) Int. Cl.
*D21C 3/26* (2006.01)
*D21C 7/06* (2006.01)

(56) References Cited

U.S. PATENT DOCUMENTS

| | | | | |
|---|---|---|---|---|
| 2005/0279468 | A1 | 12/2005 | Stromberg | |
| 2008/0302492 | A1* | 12/2008 | Shin | D21C 1/02 162/19 |
| 2011/0120663 | A1 | 5/2011 | Engstrom et al. | |
| 2012/0211183 | A1 | 8/2012 | Leavitt et al. | |
| 2016/0145797 | A1 | 5/2016 | Mc Canty | |

FOREIGN PATENT DOCUMENTS

| | | | |
|---|---|---|---|
| JP | 2000508721 | A | 7/2000 |
| JP | 2001316992 | A | 11/2001 |
| JP | 2013512350 | A | 4/2013 |
| RU | 2268327 | | 1/2006 |
| RU | 2413809 | | 3/2011 |
| WO | 02086206 | | 10/2002 |

OTHER PUBLICATIONS

Written Opinion of the ISA for PCT/FI2019/050706, dated Jan. 9, 2020, 5 pages.
Russian Search Report and Translation cited in Application No. 2021112367 completed Dec. 13, 2021, 4 pages.
Russian Office Action and Translation cited in Application No. 2021112367 dated Dec. 14, 2021, 6 pages.
JP Office Action cited in 2021-518525 with Translation, dated Aug. 30, 2023, 6 pages.

* cited by examiner

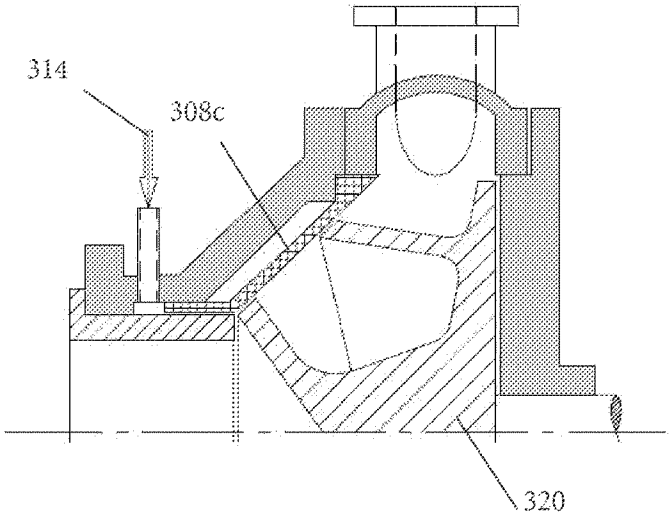
FIG. 3c
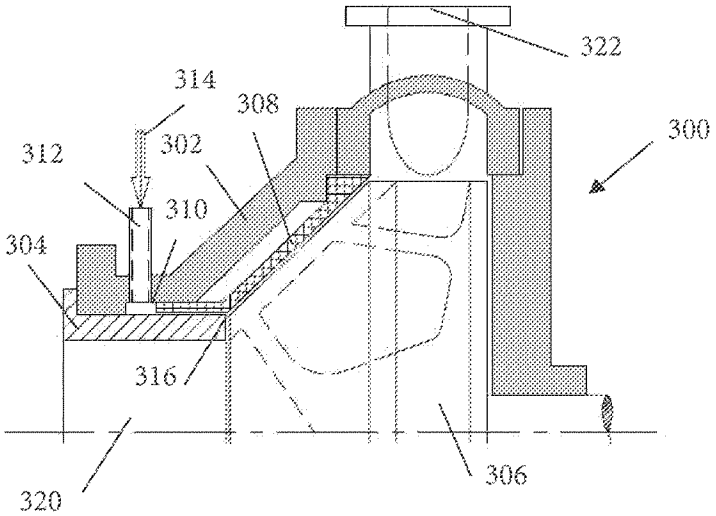
FIG. 3a
FIG. 3b
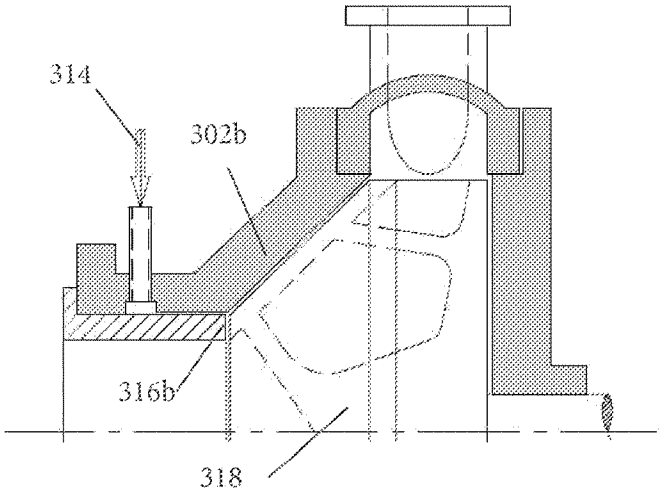

METHOD OF FEEDING WOOD CHIPS TO A PREHYDROLYSIS REACTOR

RELATED APPLICATIONS

This application is the U.S. national phase of International Application PCT/FI2019/050706 filed Oct. 2, 2019, which designated the U.S. and claims priority to Finnish Patent Application FI 20185831 filed Oct. 3, 2018, the entire contents of each of these applications are incorporated by reference.

FIELD OF TECHNOLOGY

The invention relates to a method for a hydrolysis treatment and cooking of cellulosic fiber material, preferably wood chips. Particularly, the invention relates to a method of feeding a slurry of chips and liquid to a prehydrolysis stage.

BACKGROUND AND BRIEF DESCRIPTION OF THE INVENTION

In conventional systems, wood chips (or other cellulosic or fiber material) undergo hydrolysis in a first reactor vessel prior to introduction to a second vessel, e.g., a digester. One such system is described in US20080302492. Wood chips are introduced from a chip feed assembly to an upper inlet in a prehydrolysis reactor vessel, where the chips are hydrolyzed in the upper region of the reactor vessel by adding pressure and heat energy to the vessel. Hydrolysate is extracted from the cellulosic material through an extraction screen below the upper region and in the first reactor vessel. A wash liquid is introduced to a lower region of the first reactor vessel where the wash liquid suppresses hydrolysis of the cellulosic material in the lower region. The wash liquid flows upward through the cellulosic material to the extraction screen. The treated material is discharged from a lower outlet of the reactor vessel and introduced to a digester to digest the material to produce pulp.

The high pressure in the transport device typically provides the force to move the chips up to a top separator at the top of the prehydrolysis reactor and to increase the pressure of the feed material to substantially above atmospheric pressure. The transport device may be one or more centrifugal pumps arranged in series, such as in the Turbofeed® sold by Andritz Group. The feed material and liquid move from the pumps to the top separator in an upper region of the prehydrolysis reactor vessel.

In a continuous prehydrolysis kraft cooking process typically only water is fed to the chip feed system to provide enough liquid to convey chips successfully over an inverted top separator into a prehydrolysis vessel. Because the chips are slightly acidic after steaming in the chip bin, the pH level in the feed circulation is typically about 5. In regard to the prehydrolysis, it is important to avoid alkaline sources in the feed system, because it would slow down the acidic autohydrolysis reactions. It has been found out that a slightly acidic pH has negative effects on chip pump operation. Under acidic conditions pin chips accumulate between the chip pump impeller and liner, and the pin chips do not soften in the same way as under strongly alkaline (pH 12-14) conditions, such as in Kraft cooking systems. The hard accumulated pin chips start to create friction and wear on the impeller and the liner which is indicated by an increase in the pump motor load. The chip pump wear rate has been typically 5-10 times faster in acidic prehydrolysis kraft cooking systems than in alkaline kraft cooking feed systems.

An object of the present invention is to provide a method and a system, in which the chip pump wearing rate can be decreased.

According to the invention the pH level in a prehydrolysis Kraft cooking feed system is increased to a range 7-10, preferably 8-9.5 by adding white liquor or other alkali to prevent chip pump wearing. Alkali is preferably added directly to a chip pump or chip pumps.

Surprisingly it has been found out that even very slightly alkaline conditions improve the situation from the pump wearing point of view. Already at a pH level of 8-9.5 there is much less chip pump wear. At the same time a very small amount of alkali is needed to increase the feed system pH to the above-mentioned level and the negative effect on autohydrolysis is very small. So the chip pump wear rate can be reduced significantly by adding a small amount of alkaline chemicals to the feed system by maintaining the feed circulation pH at a level of 7-10, preferably 8-9.5, without significant disturbances in the prehydrolysis stage.

Basically any alkaline chemicals may be used for the pH control, but white liquor or oxidized white liquor are most preferred, because these chemicals are already available at the (prehydrolysis) kraft pulp mill. Alkali can be diluted with water fed into the feed system.

Alkali is added to the interior of the pump in which the chip slurry is flowing. Preferably it is added between the pump casing and the pump impeller. The pump casing is provided with a conduit and an opening for introducing alkali to the pump. The pump is typically a screw centrifugal pump having a casing including a conical suction casing part, spiral casing part, an inlet opening and an outlet opening. The impeller may be open or closed. The closed impeller is provided with a conical shroud which is fixed to the outer periphery of the screw blade. The pump may be further provided with a liner between the suction casing and the impeller.

If the pump is provided with the liner, a preferable point to feed the alkaline liquor is a gap or passage between the pump impeller and the liner. In that case a critical part of the pump meets the highest alkali concentration. This gives the best effect on the reduction of wear.

The chip feed system may include one or more pumps for feeding chips. Two or more pumps may be connected in series or parallel. Alkali is typically added to the first pump in chip flow direction. Alkali may also be added to other pumps after the first pump.

SUMMARY OF FIGURES

FIGS. 3*a, b* and *c* show a fragmentary sectional view of screw centrifugal pumps.

DETAILED DESCRIPTION OF THE INVENTION

In a two-reactor vessel system, steam is introduced to the top of both vessels for heating and pressurizing purposes. Hydrolysis occurs in the first reactor vessel. Extraction screens in the first reactor vessel remove hydrolysate as the wood chips introduced at the top of the first vessel progress through the vessel and to a lower extraction port of that vessel.

The second reactor vessel is a continuous digester vessel, such as a vapor or steam phase digester. The first and second reactor vessels may be substantially vertical, have a height of at least 30 meters, for instance 50-70 meters, an inlet in an upper section of the vessel, and a discharge proximate a bottom of the vessel. Heat energy added to the reactor vessels may be pressurized steam at or above atmospheric pressure.

Figure 1:
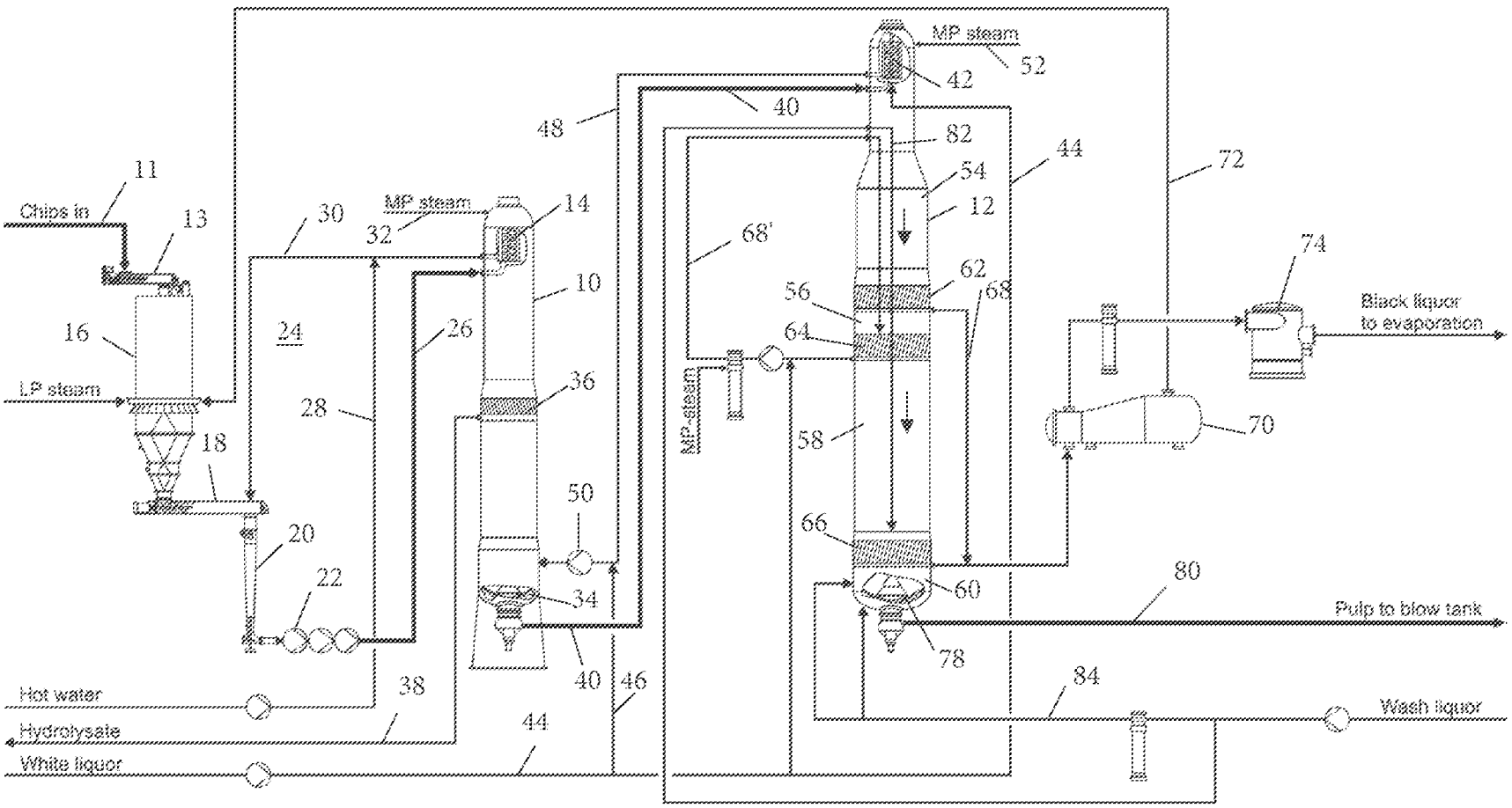
FIG. 1 is a schematic diagram of a continuous pulping system having a chip feed, hydrolysis reactor and a continuous digester reactor, where the present invention may be applied.

FIG. 1 is a schematic diagram of an exemplary chip feed and pulp processing system having a chip feed system 24, a first reactor vessel 10 (hydrolysis reactor) and a continuous pulp digester 12. The first reactor vessel includes an inverted top separator 14 that receives a slurry of cellulosic material and liquid from a conventional chip feed assembly 24 via chip feed line 26.

The chips are transported through a chip feed line 11 and fed via the screw conveyor 13 to the chip bin 16. The chip bin 16 may be a conventional chip bin, such as the Diamondback® chip bin supplied by Andritz Group. Low pressure steam may be added via steam line to the chip bin, such that the temperature and pressure of the chips in the chip bin may be controlled.

The chip bin 16 is connected to a double screw chip meter 18 and a chip chute 20. Hot water is added via pipes 28 and 30 to the chips in the chip chute 20 to form a slurry of chips.

Separated liquid discharged from the top separator 14 and extracted to pipe 30 may be mixed with hot water. The mixture flows through pipe 30 to the chip tube 20. The mixture of liquid discharged from the top separator 14 and hot water 28 is controlled to be at a temperature lower than the normal hydrolysis temperature, e.g., preferably 170° C. of the chips. The temperature of the water and liquid discharged from the top separator is preferably in a range of 100° C. to 120° C.

To feed chips to the first reactor vessel, the slurry of cellulosic material is pumped via one or more pumps 22 (such as the TurboFeed™ system as sold by Andritz Group) to the top separator of the first reactor.

The first reactor vessel 10 may be controlled based on either or both the pressure and temperature in the vessel. Pressure control may be accomplished by use of a controlled flow of steam via steam pipe 32 or in addition an inert gas added to the first reactor vessel. A gaseous upper region in the first reactor vessel is above the upper level of the chip column.

Steam in line 32 is supplied at a temperature above the normal hydrolysis temperature, e.g., 170° C., to enable hydrolysis to occur in the cellulosic slurry in the first reactor vessel. The steam is added in a controlled manner that, at least in part, promotes hydrolysis in the first reactor vessel. The steam is added via lines 32 at or near the top of the first reactor vessel, such as to the vapor phase of the vessel. The steam introduced to the first reactor vessel elevates the temperature of the cellulosic slurry to or above the normal hydrolysis temperature, e.g., above 150° C.

The cellulosic material slurry that is fed to the inverted top separator 14 in the first reactor vessel may have excessive amounts of liquid to facilitate flow through the transport pipe 26. Once in the vessel, the excess liquid is removed as the slurry passes through the top separator 14. The excess liquid removed from the separator is returned via pipe 30 to the chip feed system, e.g., to the chip tube 20, and reintroduced to the slurry to transport the cellulosic material to the top of the first vessel.

The top separator 14 discharges chips or other solid cellulosic material to a liquid phase (below upper chip column) of the first reactor vessel. The top separator pushes the material from the top of the inverted separator 14 and into a gas phase. The pushed out material may fall through the gas phase in the vessel and to the upper chip column of chips and liquid contained in the first reactor vessel. The temperature in the gas phase (if there is such a phase) and in the first reactor vessel 10 is at or above the normal hydrolysis temperature, e.g., at or above 170° C. The slurry of cellulosic material gradually flows down through the first reactor vessel. As the material progresses through the vessel, new cellulosic material and liquid are added to the upper surface from the top separator.

Hydrolysis occurs in the first reactor vessel 10, where the temperature is maintained at or above the normal hydrolysis temperature. The hydrolysis will occur at a lower temperature, e.g., below 150° C., by the addition of acid, but preferably hydrolysis occurs at high temperatures, above 150° C. to 170° C. using only water and recirculated liquid from the top separator of the first reactor vessel. Hydrolysate is removed through an extraction screen 36 or a set of multiple elevations of extraction screens 36. The extraction screen (not shown) may be located in the bottom region of the reactor 10, wherein hydrolysis occurs substantially above the screen. In FIG. 1 the extraction screen 36 is disposed in the upper part of the reactor so that less treated hydrolysate is removed from the reactor. The retention time in the hydrolysis stage before extraction is typically 60-80 minutes, but in FIG. 1 the screen 36 is located already after a retention of 10-40 minutes, preferably 20-30 minutes. The hydrolysis reactions are completed below the screen 36. There may be additional screen(s) below screen 36 for removing hydrolysate.

Hydrolysate is a product of hydrolysis. The hydrolysate is removed through the extraction screen 36 and fed to pipe 38. The hydrolysate or a portion of it may be recovered by a conventional hydrolysate recovery system.

The amount of liquids added to the chip slurry in the chip chute 20 may be controlled to avoid excessive changes to the pH of the chip slurry, e.g., to avoid making the slurry excessively alkaline or excessively acidic. The addition of liquid to the cellulosic material in the chip tube 20 assists in conveying the chip slurry material through the chip pumps 22 and through the chip slurry pipes 26 extending between the chip chute 20 and the top separator 14 of the first reactor vessel 10.

The treated chips are discharged through the bottom 34 of the prehydrolysis reactor vessel 10 and sent via a chip transport pipe 40 to the top separator 42, e.g., an inverted top separator, of the digester vessel 12, such as a continuous digester.

Additional liquid, from pipe 48, may be added to the bottom of the first reactor vessel. The additional liquid may be extracted from the top separator 42 of the second reactor vessel 12. The additional liquid may be recirculated by pumping (via pump 50) to the bottom 36 of the first vessel as part of the liquid used to assist in the discharge of the chips from the first vessel. White liquor is added through lines 44 and 46 to pipe 48 and further to the bottom of the first reactor.

Steam may be added via pipe 52 to the top of the digester 12.

Cooking chemicals, e.g., white liquor 44, are added to the top, e.g., to an inverted top separator 42 of the second reactor vessel 12. A portion of these cooking chemicals may be introduced to the circulation line 48 extracting liquor from the top separator 42 and adding liquor to the bottom of the first reactor vessel. White liquor is added to the top separator of the second reactor vessel 12 to promote the mixing of liquor with the cellulosic material in the separator and before the mixture of material and liquor is discharged from the separator to the second reactor vessel.

The temperature in the cooking vessel 12 is elevated and controlled by the addition of medium pressure steam 52 and possibly air or an inert gas. The cooking vessel may be a vapor phase or hydraulic phase vessel operated at a pressure that is in balance with the pressure in the prehydrolysis reactor vessel 14. The pressure at the bottom of the prehydrolysis reactor vessel is a combination of the medium steam pressure and the hydraulic pressure of the chip and liquid column in the vessel 14. This combined pressure is greater than the pressure at the top of the cooking vessel, which may be at the pressure of the medium pressure steam 52. The pressure differential between the bottom of the prehydrolysis reactor vessel and the top of the cooking vessel moves the feed material through line 40. Further and where a hydraulic digester cooking vessel is used, a heating circulation may be used to heat the feed material to the desired cooking temperature.

The cooking vessel 12 may have multiple zones of concurrent and counter-current flow. An upper cooking zone 54 may have a concurrent flow of the feed material and liquor. A portion of the black liquor is extracted through screens 62 at the bottom of the upper cooking zone. The extracted black liquor flows through line 68 to provide heat energy for a reboiler 70. Clean low pressure steam generated in the reboiler flows via line 72 to provide heat energy to the chip bin 16. The black liquor flows from the reboiler to a black liquor filter 74. The filtered liquor flows to weak black liquor tanks for further processing in the black liquor evaporation system. Other heat recovery systems that recover heat from the hot black liquor, such as flash tanks and heat exchangers, may be used with or in place of the reboiler 70.

In a middle cooking zone 56, the feed material continues to move downward and a counter-current flow of black liquor flows up through the zone 56. Additional liquor is extracted through screen(s) 64 to pipe 68'. White liquor 44 may be added to the black liquor flow. The combined flows of black liquor and white liquor are recirculated to the cooking vessel via a center pipe 82 that adds the combined fluid at or below the screens 64.

The rate at which the combined flow is added through the center pipe 82 and the rates at which liquor is extracted through screens 62 and 64 are adjusted such that liquor flows upward through the middle cooking zone and downward through a lower cooking zone 58. The lower cooking zone may have a length of zone-third, one-half or more of the vertical length of the digester vessel 16.

A wash zone 60 at the bottom of the cooking vessel washes the feed material to extract black liquor. Wash liquor 84 flows through a wash line to the lower region of the wash zone and through a center pipe 82 to the wash zone. As the wash liquor flows up through the wash zone, the black liquor and other chemicals in the feed material are entrained, flow upwards and are extracted through the screen 66.

A bottom discharge assembly 78 discharges the washed feed material from the cooking vessel via line 80 to the blow tank (not shown). The pressure of the feed material is released in the blow tank. From the discharge of the blow tank, the feed material, which is now dissolved pulp, is pumped to further processing such as a brown stock washer (not shown).

Figure 2:
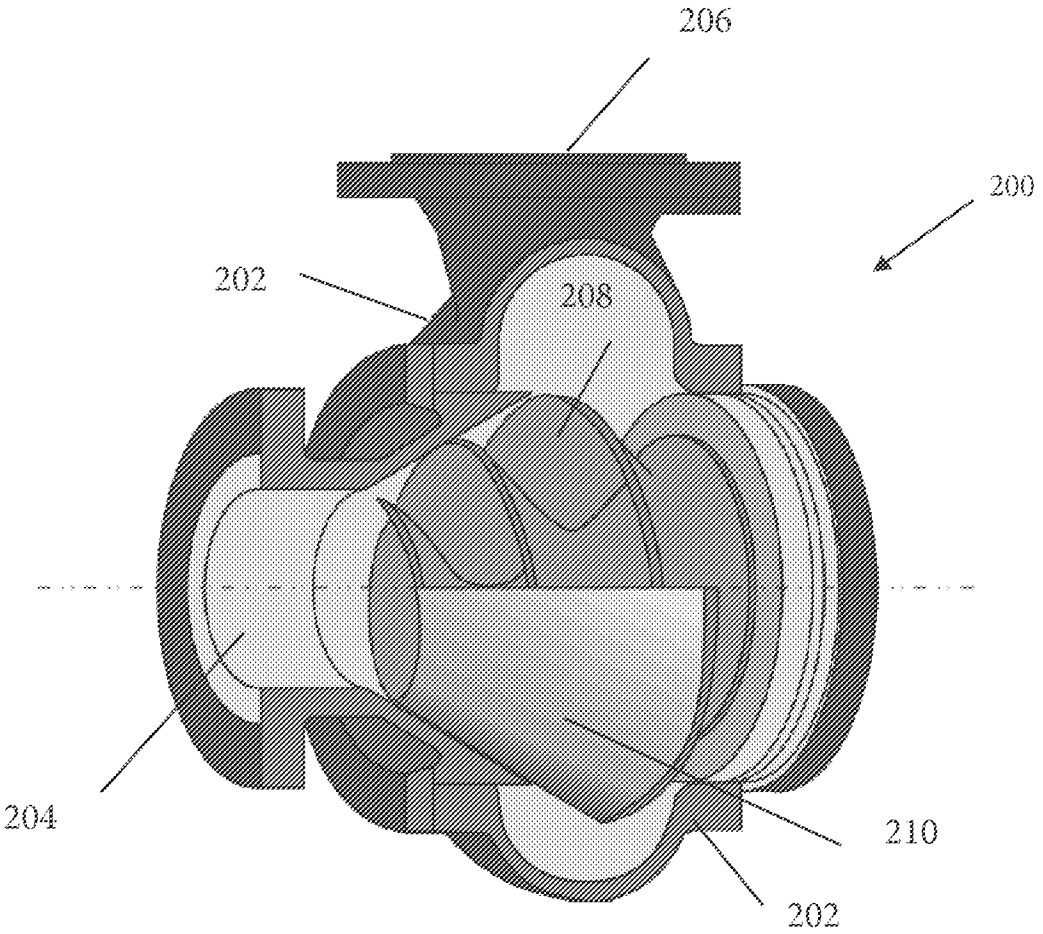
FIG. 2 shows a side view of a screw centrifugal pump for chip pumping.

FIG. 2 shows a side view of a typical screw centrifugal pump for chip pumping. The pump has a casing 202 and a screw impeller 208 and an inlet opening 204 and an outlet opening 206 for a slurry of chips and liquid. The impeller may be open or closed. The closed impeller is provided with a conical shroud 210 which is fixed to the outer periphery of the screw blade. The pump may be further provided with a liner between the suction casing and the impeller (FIG. 3).

FIGS. 3*a, b* and *c* show a fragmentary sectional views of screw centrifugal pumps.

In FIG. 3*a* the pump 300 has a suction casing part 302, a wear ring 304, a closed screw impeller 306 and a liner 308 between the suction casing and the impeller. The pump further has an inlet 320 and an outlet 322 for a flow of the chip slurry. An opening 310 and a conduit 312 are arranged in the suction casing for introducing alkali 314 to the pump. The alkali is directed to a gap 316 between the impeller and the liner 308 in which gap the alkali and the chip slurry come into contact, and the pH of the slurry will be increased. This way the pump wear rate can be reduced.

In FIG. 3*b* there is no liner between the suction casing 302*b* and the closed impeller 318. In this case alkali 314 is introduced to a gap 316*b* between the impeller 318 and the suction casing 302*b*.

In FIG. 3*c* the impeller 320 is open. Alkali 314 is directed between the impeller 320 and the liner 308*c*.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A method comprising:

feeding a slurry of chips and liquid to a prehydrolysis reactor in the production of dissolving pulp, in which method the slurry is pumped by using at least one pump to the prehydrolysis reactor, feeding alkali into the at least one pump to increase a pH of the slurry to be in a pH range of 7 to 10 to reduce a pump wear rate of the at least one pump, hydrolyzing the chips in the prehydrolysis reactor, discharging the chips from the prehydrolysis reactor and feeding the chips to a continuous digester vessel;

cooking the chips in the continuous digester vessel to convert the chips to pulp, and discharging the pulp from the continuous digester vessel.

2. The method according to claim 1, wherein the alkali is fed to an interior of a pump of the at least one pump through an alkali inlet on the pump which is separate from an inlet to the pump for the slurry.

3. The method according to claim 2, wherein the alkali inlet is positioned between a pump casing and a pump impeller of the pump.

4. The method according to claim 2, wherein the pump is a screw centrifugal pump provided with a liner, wherein the alkali inlet introduces the alkali into a gap or passage between the impeller and the liner.

5. The method according to claim 1, wherein the pH range is 8 to 9.5.

6. The method according to claim 2, wherein the alkali is led to the pump through a conduit and an opening in a wall of the pump casing.

7. The method according to claim 4, wherein the impeller is open or closed.

8. The method according to claim 1, wherein the alkali comprises at least one of white liquor and oxidized white liquor.

9. A method comprising:

pumping with a pump a slurry of liquid and chips of cellulosic fiber material increasing a pH of the slurry flowing through the pump to a pH range of 7 to 10 by feeding alkaline into the slurry flowing to or flowing through the pump to reduce a pump wear rate of the pump; and feeding the slurry flowing from the pump into to a prehydrolysis reactor, hydrolyzing the chips in the prehydrolysis reactor, extracting hydrolysate from the chips in the prehydrolysis reactor;

discharging the chips from the prehydrolysis reactor and feeding the chips to a continuous digester vessel;

cooking the chips in the continuous digester vessel to convert the chips into pulp, and discharging the pulp from the continuous digester vessel.

10. The method of claim 9 wherein the pH range is 8 to 9.5.

11. The method of claim 10 further comprising: washing the chips in the continuous digester vessel.

12. The method of claim 11 further comprising:

storing the chips in a chip bin; and discharging the chips from the chip bin and mixing the chips with the liquid to form the slurry upstream of the pump.

13. The method of claim 10, wherein the feeding of the alkali includes feeding the alkaline through a housing of the pump and into a flow passage for the slurry in the housing.

14. The method according to claim 10, wherein the pump includes a pump casing and an impeller within the pump casing, and the feeding of the alkali includes feeding the alkaline through the pump casing and into a gap between the pump casing and the impeller.

15. The method according to claim 10, wherein the pump comprises a screw centrifugal pump including a screw impeller and a liner that at least partially encloses the screw impeller, wherein the alkali is introduced to a gap or passage between the impeller and the liner.

16. The method according to claim 10, wherein the feeding of the alkali includes flowing the alkali through a conduit connected to an opening in a wall of a casing of the pump, and the alkali flows from the conduit, through the wall and into a flow passage for the slurry in the casing.

17. The method according to claim 10, wherein the pump includes at least one of an open impeller or a closed impeller.

18. The method according to claim 10, wherein the alkali comprises at least one of white liquor and oxidized white liquor.

* * * * *